US005522197A

United States Patent [19]

Ebeling

[11] Patent Number: 5,522,197

[45] Date of Patent: Jun. 4, 1996

[54] METHOD IN CONNECTION WITH A ROOF DRAINAGE APPARATUS AND A ROOF DRAINAGE APPARATUS

[75] Inventor: Olavi Ebeling, Helsinki, Finland

[73] Assignee: Oy Kolster AB, Helinski, Finland

[21] Appl. No.: 211,645

[22] PCT Filed: Sep. 22, 1992

[86] PCT No.: PCT/FI92/00249

§ 371 Date: Apr. 11, 1994

§ 102(e) Date: Apr. 11, 1994

[87] PCT Pub. No.: WO93/08346

PCT Pub. Date: Apr. 29, 1993

[30] Foreign Application Priority Data

Oct. 14, 1991 [FI] Finland ..... 914836

[51] Int. Cl.[6] ..... E04D 13/04

[52] U.S. Cl. ..... 52/741.1; 52/11; 52/14; 52/16; 52/302.1; 52/302.7; 138/45; 285/42

[58] Field of Search ..... 52/11, 14, 16, 52/302.1, 302.6, 302.7, 741.1; 138/45, 44, 46; 285/42; 210/163, 166

[56] References Cited

U.S. PATENT DOCUMENTS

| | | | |
|---|---|---|---|
| 1,657,663 | 1/1928 | Devereux | 138/45 |
| 2,568,519 | 9/1951 | Smith | 138/45 |
| 3,469,698 | 9/1969 | Blendermann | 52/12 X |
| 3,970,105 | 7/1976 | Pelton et al. | 138/45 |
| 4,144,041 | 3/1979 | Hou | 138/46 |
| 5,032,264 | 7/1991 | Geiger | 138/45 |

FOREIGN PATENT DOCUMENTS

| | | |
|---|---|---|
| 0122800 | 10/1984 | European Pat. Off. . |
| 1806527 | 5/1970 | Germany . |
| 1200990 | 8/1970 | United Kingdom . |
| WO83/03114 | 9/1983 | WIPO . |
| WO90/02232 | 3/1990 | WIPO . |

*Primary Examiner*—Carl D. Friedman
*Assistant Examiner*—Laura A. Saladino

[57] ABSTRACT

The invention relates to a method in connection with a roof drainage apparatus and a roof drainage apparatus. The invention comprises a trough (2) recessed in a roof structure (1), an opening (3) arranged in the bottom of the trough, a water-outlet tube (4) joined to the opening and a means (5) for changing an open water flow into a closed flow when the water flow is increasing. For intensifying the drainage, an element (6) is positioned in the water-outlet tube (4) at a throat after the opening (3), by means of which element the cross-sectional area of the water-outlet tube (4) is regulated in such a manner that the shape of the cross-section of the water-outlet tube (4) remains substantially unchanged at the regulation.

3 Claims, 1 Drawing Sheet

FIG. 1
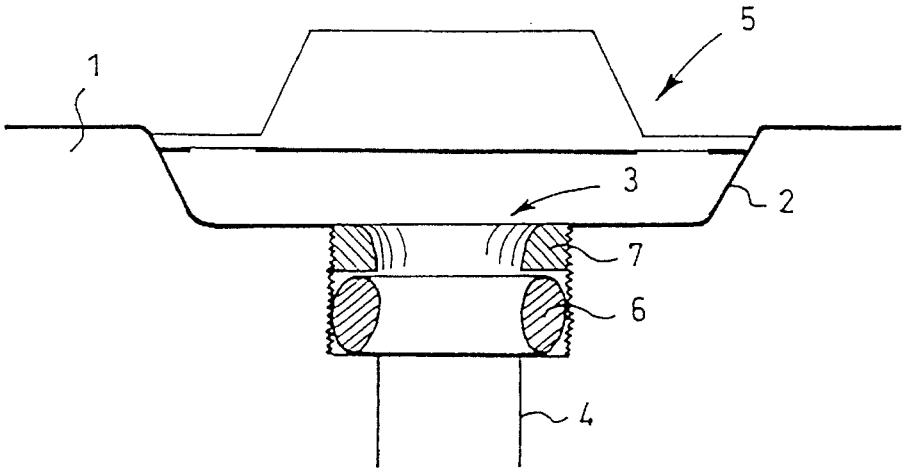
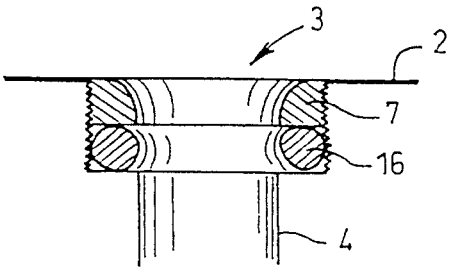
FIG. 3
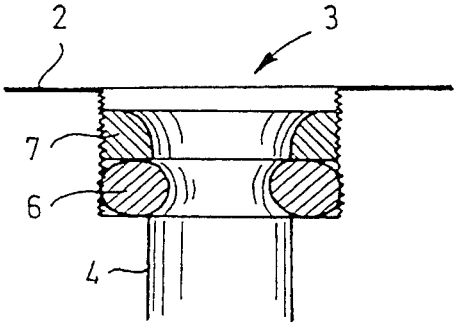
FIG. 2
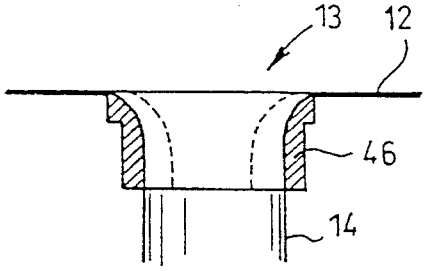
FIG. 4
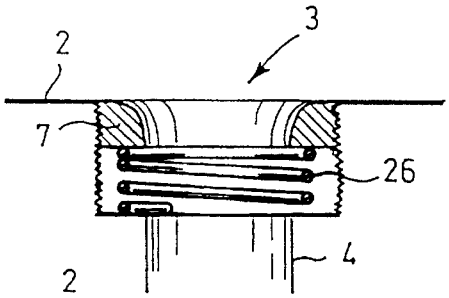
FIG. 5
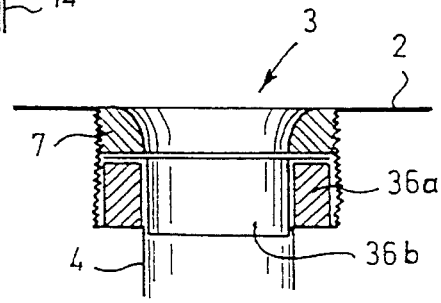
FIG. 6

METHOD IN CONNECTION WITH A ROOF DRAINAGE APPARATUS AND A ROOF DRAINAGE APPARATUS

BACKGROUND OF THE INVENTION

The invention relates to a method in connection with a roof drainage apparatus, in which a water flow, when increasing, is changed from an open flow into a closed flow and directed into a water-outlet tube through an opening arranged in the bottom of a trough recessed in a roof structure. The invention also relates to a roof drainage apparatus.

Such solutions are well-known at present. As an example of prior art solutions can be mentioned an apparatus disclosed in Finnish Patent 70446. In this known solution the opening is arranged directly in the roof level. The means changing open flow into closed flow comprise a plate positioned above the opening, the size of the plate and its distance from the roof level being dimensioned according to criteria causing closed flow.

Another example of a prior art solution is an apparatus disclosed in Finnish Patent 75394. This apparatus utilizes the same basic principle causing closed flow as the apparatus according to Finnish Patent 70446. However, in the apparatus according to Finnish Patent 75394, the opening is arranged in a trough recessed in the roof structure and not directly in the roof level as in Finnish Patent 70446 mentioned above.

The above-mentioned solutions work very well in principle, but drawbacks have nevertheless been observed especially in connection with large roofs provided with several roof outlets joined to the same tube system. These drawbacks are due to the fact that it is difficult to provide separate roof outlet branches with correct flow resistances. In the event that the separate roof outlet branches cannot be provided with correct flow resistance, the system does not function in the best possible manner, and in the worst case, the system does not function at all. An additional inconvenience is also that tubes in different diameters are available to a relatively restricted extent, and it is therefore often necessary in practice to make compromises when choosing tubes. Further inconveniences are caused by the fact that it has not been possible to regulate the flow resistances of the separate roof outlet branches after the installation of the tube system. It shall be noted that the system is rather sensitive to blockages caused by impurities, so that flaps or the like of whatever kind cannot be used, if a reliable function of the system is desired in all circumstances.

SUMMARY OF THE INVENTION

The object of the invention is to provide a method and an apparatus by means of which the drawbacks of the prior art technique can be eliminated. This has been achieved by means of the solution of the invention. The method according to the invention is characterized in that the cross-sectional area of the water-outlet tube is regulated in a throat after the opening arranged in the bottom of the trough in such a manner that the shape of the cross-section remains substantially unchanged. On the other hand, the drainage apparatus according to the invention is characterized in that an element is positioned in the water-outlet tube at the throat after the opening, by means of which element the cross-sectional area of the water-outlet tube can be regulated in such a way that the shape of the cross-section of the water-outlet tube remains substantially unchanged at the regulation.

In comparison with the prior art technique, the primary advantage of the invention is that the flow resistances of the separate roof outlet branches can be regulated after the installation in a rather simple manner. It is thus possible to regulate the system to function practically optimally in each particular roof structure. A further advantage is that flow resistances can be regulated within a very wide range, which makes the system function reliably even in very difficult cases. Flow resistance can be changed within a range of 0 up to 90%. An advantage of the invention is also that a regulating element can easily be formed such that impurities do not stick to it, and therefore, no detrimental blockage can occur. It is also simple to arrange a double sieve in the apparatus of the invention, which means easy cleaning, for instance, and an elimination of difficulties caused by blockage. Still an advantage of the invention is its simplicity, due to which the drainage apparatus of the invention functions reliably, the need of maintenance is little and the invention can be introduced advantageously.

BRIEF DESCRIPTION OF THE DRAWINGS

The invention will be explained in the following by means of preferable embodiments of the invention shown in the enclosed drawing, in which FIG. 1 shows a side view of a drainage apparatus according to the invention in principle, FIG. 2 shows a substantial detail of the apparatus of FIG. 1 after the regulation of a flow resistance and FIG. 3 to 6 show different alternative embodiments of the apparatus according to the invention.

DESCRIPTION OF THE PREFERRED EMBODIMENTS

FIG. 1 shows a side view of one preferable embodiment of a roof drainage apparatus according to the invention in principle. Reference numeral 1 indicates a roof structure of a building. Reference numeral 2 of FIG. 1 indicates a trough, in the bottom of which is arranged an opening 3. To the opening 3 is joined a water-outlet tube 4, by means of which the water is led to a place desired. Reference numeral 5 of FIG. 1 indicates generally means for changing an open water flow into a closed flow when the water flow is increasing.

The facts mentioned above belong to a technique fully conventional to one skilled in the art, and therefore, these facts are not presented more accurately in this connection. It is only stated in general that for instance changing open flow into closed flow and the details of the apparatus and the principles used thereby appear e.g. from Finnish Patent 70446. As to these facts, reference is made to the above-mentioned Finnish Patent as prior art.

The substantial feature of the invention is that the cross-sectional area of the water-outlet tube 4 is regulated in a throat after the opening 3 arranged in the bottom of the trough 2 in such a manner that the shape of the cross-section remains substantially unchanged. The cross-sectional area can be regulated by throttling the water-outlet tube 4, preferably along the whole perimeter. The regulation of the cross-section of the water-outlet tube 4 can be carried out for instance by means of an element 6 positioned at the throat. The element 6 extends over the whole perimeter of the water-outlet tube 4 and throttles the water-outlet tube 4 along its whole perimeter. In the embodiment of FIG. 1 the element 6 is an annular part of an elastic material, such as rubber, which is arranged to expand inwards at axial compression and thus to throttle the cross-sectional area of the water-outlet tube 4. The axial compression of the element 6 can take place by means of an annular compression part 7, for instance. The axial movement of the compression part can be provided e.g. by means of a thread structure. Throttling the water tube is seen especially well from FIG. 2, which shows the throat of the water-outlet tube 4 of the embodiment according to FIG. 1 after the regulation of the flow resistance, i.e. after throttling the water tube. From FIG. 2 can be seen that the annular compression part 7 has moved downwards and compressed the element 6, and then the element has expanded inwards and throttles thus the water-outlet tube 4 and increases the flow resistance. The flow resistance can naturally be reduced by turning the compression part 7 in the opposite direction, in which case the compression part moves upwards and the element can return towards the shape according to FIG. 1. By this arrangement it is possible to regulate the size of the flow opening of the water-outlet tube 4 in such a way that the cross-sectional area of the water-outlet tube remains unchanged, i.e. a round cross-section remains round in spite of regulation etc. The regulation takes place by changing the value of single resistance. Let the single resistance value of the whole apparatus without throttling be $\zeta_1$. The pressure loss caused by the flow is then $$\Delta p_1 = \zeta_1 \frac{w_1^2}{2g} \gamma,$$

in which $\Delta p_1$=pressure loss mm water column, $w_1$=speed in the throat m/s, g=acceleration of gravity 9,81 m/s$^2$, $\lambda$=volume weight of water kg/m$^3$=1000. If a throttling point is arranged in the throat, the single resistance value of throttling $\zeta_2$ is, depending on inlet and outlet roundings and expressed for the speed at the throttling point, 0,5÷1,6. The pressure loss of throttling is $$\Delta p_2 = \zeta_2 \frac{w_2^2}{2g} \gamma,$$

in which $w_2$=speed at the throttling point. $\Delta p_2$ is expressed as a function of the speed $w_1$.

$$\frac{\pi d_1^2}{4} \cdot w_1 = \frac{\pi d_2^2}{4} \cdot w_2,$$

because cross-section×speed is equal at each point, $d_1$=diameter of water-outlet tube before throttling point, $d_2$=diameter of water-outlet tube at throttling point, from which $$w_2 = \left(\frac{d_1}{d_2}\right)^2 \cdot w_1.$$

$w_2$ is substituted in the formula of the pressure loss of throttling $$\Delta p_2 = \zeta_2 \left(\frac{d_1}{d_2}\right)^4 \frac{w_1^2}{2g} \gamma.$$

The total resistance of the roof outlet is the total of the partial resistances;

$$\Delta p_{tot} = \zeta_1 \frac{w_1^2}{2g} \gamma + \zeta_2 \left(\frac{d_1}{d_2}\right)^4 \frac{w_1}{2g} \gamma =$$

-continued $$\left[\zeta_1 + \zeta_2 \left(\frac{d_1}{d_2}\right)^4\right] \frac{w_1^2}{2g} \gamma,$$

from which appears that the single resistance value of a roof outlet provided with throttling is $$\Delta p_{tot} = \zeta_1 + \zeta_2 \left(\frac{d_1}{d_2}\right)^4.$$

Example: Let the single resistance value of a roof outlet without throttling be $\zeta_1$=0,3 and that with throttling for its own diameter ($d_2$) $\zeta_2$=0,5 and the inner diameter of the throat $d_1$=50 mm and that of throttling $d_2$=10 mm. Then $$\zeta_{tot} = 0{,}3 + 0{,}5 \left(\frac{50}{10}\right)^4 =$$

312,8 and the ratio $\frac{\zeta_{tot}}{\zeta_1}$ = 312,8/0,3 = 1043.

The pressure losses are throttled and unthrottled as follows

| w m/s | unthrottled Δp mm water column | throttled Δp mm water column |
|---|---|---|
| 0,3 | 1,38 | 1435 |
| 0,5 | 3,82 | 3987 |
| 1 | 15,29 | 15949 |

Consequently, by throttling according to the invention it is possible to provide very large additional pressure losses for balancing the flow resistances of the separate branches.

The shape of the cross-sectional surface of the element can vary. In the embodiment of the FIGS. 1 and 2 the cross-section is oval. In the example of FIG. 3 the cross-section of an element 16 is round. As to the rest, the embodiment of FIG. 3 corresponds to the embodiment of the FIGS. 1 and 2. In the embodiment of FIG. 5 the cross-sectional surface of an element 26 is a rectangle. As to the rest, the example of FIG. 5 corresponds to the embodiments of the FIGS. 1 to 3.

FIG. 6 shows an embodiment, in which the element comprises two parts, an elastic annular means **36*a* and a sleeve 36*b* capable of contracting and expanding. The sleeve 36*b* can for instance be a tube bent of a plate, the edges of which are not fastened together but only bent in such a way that the free longitudinal edges of the plate are capable of moving overlappingly at the regulation. As to the rest, the embodiment of FIG. 6 corresponds to the preceding embodiments. Identical reference numerals have been used for respective parts in the FIGS. 1 to 3, 5 and 6**, because the solutions are similar as far as those parts are concerned.

FIG. 4 shows an embodiment in which an element 46 is a part to be chosen according to the cross-sectional surface desired for a water-outlet tube 14, i.e. the element 46 is detached for the regulation of flow resistance and replaced by an element throttling the cross-sectional area of the water-outlet tube in a manner desired. In FIG. 4 is marked with broken lines one example of how the element in question can be. In FIG. 4, the reference numeral 12 indicates the trough and the reference numeral 13 the opening to which the water-outlet tube 14 is joined. Means for the provision of closed flow, for instance, are not shown in FIG. 4 at all, nor in the FIGS. 2, 3, 5 and 6. These means can naturally be e.g. means according to FIG. 1.

All above-mentioned solutions make it possible to regulate the flow resistance also after the installation, through which the function of the whole water-outlet system can be made very advantageous.

The embodiments above are not intended to restrict the invention, but the invention can be modified quite freely within the scope of the claims. It is thus clear that the details of the apparatus according to the invention can also be different from the ones shown in the Figures. The annular element does not necessarily need to be made of rubber, but this element can also consist e.g. of a spring element throttling the water-outlet tube when tightened. The tightening can take place in any direction. The element throttling the water-outlet tube can also be manufactured of more than one material; a closed shell manufactured e.g. of rubber or plastic and containing liquid or gas is a fully possible solution. Sieve structures and structures causing closed flow can be any solutions obvious to persons skilled in the art. In this respect, the example of FIG. 1 is to be understood as an example in principle and not as an example of some particular specified solution.

I claim:

1. A method for controlling fluid flow along a roof having a trough recessed in the roof comprising the steps of:

providing a deformable annular element in an outlet passage extending downward from the trough, the annular element defining a throat portion with a cross-sectional area and a cross-sectional shape; and moving a compression member, mounted to the outlet passage, in an axial direction while in contact with the annular element thereby deforming the annular element to adjust the cross-sectional area of the throat portion without substantially changing the cross-sectional shape of the throat portion.

2. The method of claim 1 wherein the deforming step includes throttling the outlet tube to regulate the cross-sectional area of the throat portion.

3. The method of claim 2 wherein the throat portion has a perimeter, the throttling step including throttling the outlet tube along the entire perimeter of the throat portion.

* * * * *

UNITED STATES PATENT AND TRADEMARK OFFICE

CERTIFICATE OF CORRECTION

PATENT NO. : 5,522,197

DATED : June 4, 1996

INVENTOR(S) : Olavi Ebeling

It is certified that error appears in the above-identified patent and that said Letters Patent is hereby corrected as shown below:

On the title page,

Please change the Assignee: Oy Kolster AB, Helsinki Finland

To the correct Assignee: Megsent Insinööritoimisto Oy, Kerava, Finland

Signed and Sealed this

Fourteenth Day of March, 2000

*Attest:*

*Attesting Officer*

Q. TODD DICKINSON

*Commissioner of Patents and Trademarks*